United States Patent [19]

Akly

[11] Patent Number: 5,026,191

[45] Date of Patent: Jun. 25, 1991

[54] RECHARGEABLE AND DISPOSABLE TOOTHBRUSH

[76] Inventor: Cesar Akly, 50-20 61 St., Woodside, N.Y. 11377

[21] Appl. No.: 523,865

[22] Filed: May 14, 1990

[51] Int. Cl.[5] ..... A46B 11/02

[52] U.S. Cl. ..... 401/175; 401/280

[58] Field of Search ..... 401/175, 132, 268, 270, 401/278, 279, 280, 174, 172

[56] References Cited

U.S. PATENT DOCUMENTS 4,201,490 5/1980 D'Angelo ..... 401/175

4,288,169 9/1981 McMenamin ..... 401/175

FOREIGN PATENT DOCUMENTS 2225411 12/1973 Fed. Rep. of Germany ..... 401/175

1032673 6/1966 United Kingdom ..... 401/175

*Primary Examiner*—Richard J. Johnson

[57] ABSTRACT

An improved fountain toothbrush is provided that includes a toothpaste storage compartment in the handle and a rotary mechanism for enabling toothpaste in the toothpaste storage compartment to be urged through a conduit in a head directly to the bristles which is adapted to be disposable.

1 Claim, 1 Drawing Sheet

RECHARGEABLE AND DISPOSABLE TOOTHBRUSH

BACKGROUND OF THE INVENTION

The instant invention relates generally to toothbrushes and more specifically it relates to an improved fountain toothbrush which provides a toothpaste storage compartment in the handle so that the toothpaste can be dispensed directly onto the bristles therefrom.

There are available various conventional toothbrushes which do not provide the novel improvements of the invention herein disclosed.

SUMMARY OF THE INVENTION

A primary object of the present invention is to provide an improved fountain toothbrush that will overcome the shortcomings of the prior art devices.

Another object is to provide an improved fountain toothbrush that has a toothpaste storage compartment in the handle so that the toothpaste can be dispensed directly onto the bristles therefrom.

An additional object is to provide an improved fountain toothbrush in which the dispensing mechanism in the handle can be removed and replaced so that another supply of toothpaste can be refilled within the storage compartment thus allowing the toothbrush to be used continuously.

A further object is to provide an improved fountain toothbrush that is simple, easy to use and disposable.

A still further object is to provide an improved mountain toothbrush that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
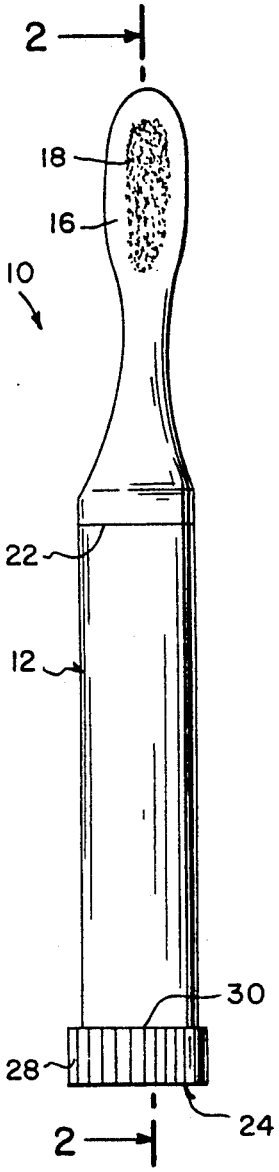
FIG. 1 is an elevational view of the invention.
Figure 2:
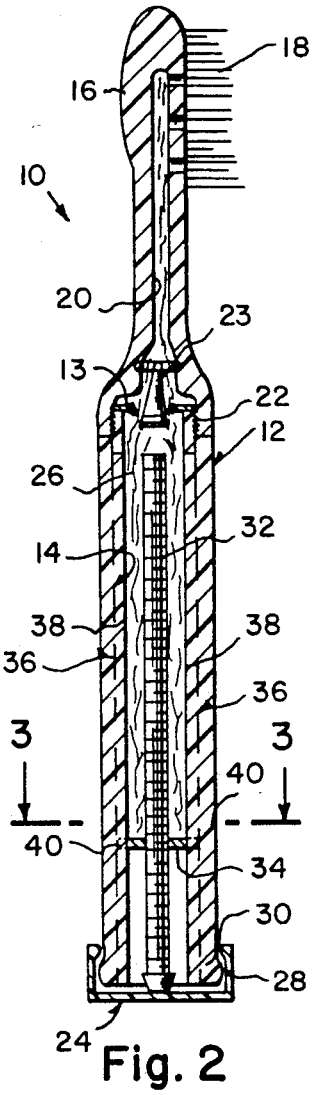
FIG. 2 is a cross sectional view taken along line 2—2 in FIG. 1.
Figure 3:
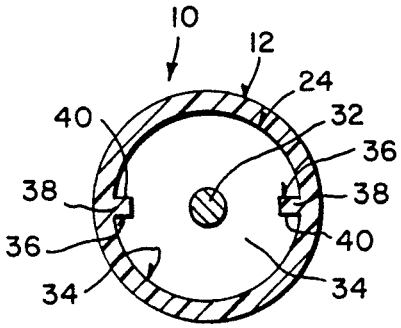
FIG. 3 is a cross sectional view taken along line 3—3 in FIG. 2, showing the follower in greater detail held by the key tracks.

Turning now descriptively to the drawings, in which similar reference characters denote similar elements throughout the several views, FIGS. 1 to 3 illustrates an improved fountain toothbrush 10 consisting of a tubular removable handle 12 having a toothpaste storage compartment 14 with a removable seal 13 at an inner end 22. A head 16 with a plurality of bristles 18 thereon has a conduit 20 therein. The head 16 is removably connected by screw threads to the end 22 of the handle 12 with the conduit 20 connecting the toothpaste storage compartment 14 in the handle 12 directly to the bristles 18 on the head 16. A rotary mechanism 24 is provided for forcing toothpaste 26 in the toothpaste storage compartment 14 through the conduit 20 to the bristles 18. A guide and seal remover sleeve 23 is mounted internally on the head 16 for breaking the seal 13 on the handle 12 when the handle is mounted on the head 16. The seal 13 may be manually removed.

The rotary mechanism 24 includes a snap-off rotary knob 28 removably attached to the other end 30 of the tubular handle 12 opposite the head 16. An elongated removable screw 32 is mounted at one end to the rotary knob 28 and extends into the toothpaste storage compartment 14 in the handle 12. A follower 34 is threaded on the screw 32 while a structure 36 is for preventing rotation of the follower 34 with the screw 32. When the rotary knob 28 is turned in the right direction the follower 34 will travel towards the head 16 on the screw 32 to urge the toothpaste 26 through the conduit 20 to the bristles 18.

The structure 36 includes the storage compartment 14 in the handle 12 having elongated key tracks 38 on the inner surface thereof. The follower 34 has key ways 40 that travel along the elongated key tracks to prevent the rotation of the follower 34 with the screw 32.

Figure 4:
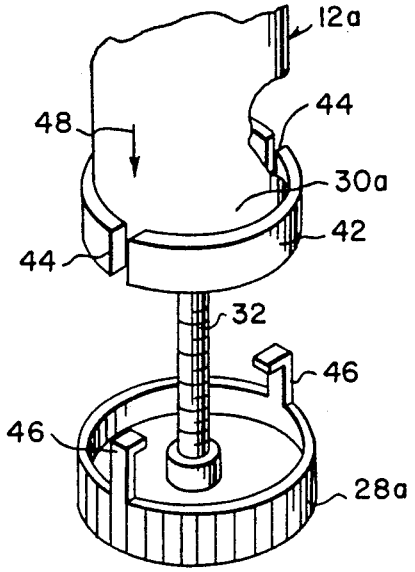
FIG. 4 is a partial exploded perspective view of a modified rotary knob in which the hook members are retained onto the rib ring through the slots when the rotary knob fits over the rib ring.

FIG. 4 shows a modification that includes a rib ring 42 having a pair of oppositely disposed transverse slots 44. The rib ring 42 is affixed to the other end **30*a* Of the tubular handle 12*a* opposite the head 16. The rotary knob 28*a* has a pair of oppositely disposed hook members 46. The hook members are retained onto the ring 42 through the slots 44 when the rotary knob 28*a* fits over the rib ring 42. An alignment arrow 48 is carried mn the tubular handle 12 above one of the slots 44 so that the rotary knob 28*a* can be properly positioned to remove the hook members 46** from the rib ring.

It should be noted that by eliminating the removable connection at end 22, the toothbrush can be marketed as a disposable item.

Figure 5:
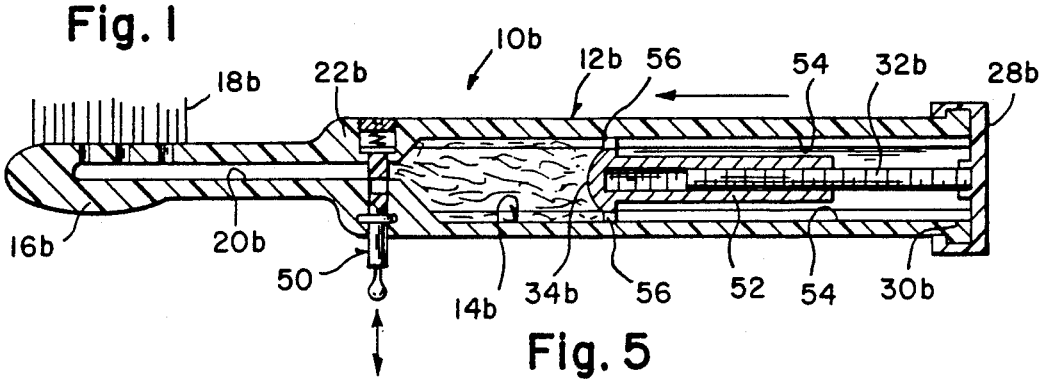
FIG. 5 is a cross sectional view similar to FIG. 2 of another modification.

FIG. 5 shows a modified improved fountain disposable toothbrush **10*b* consisting of a tubular handle 12*b* having a toothpaste storage compartment 14*b* therein. A head 16*b* with a plurality of bristles 18*b* thereon has a conduit 20*b* therein. The head 16*b* is connected to one end 22*b* of the handle 12*b* with the conduit 20*b* connecting the toothpaste storage compartment 14*b* in the handle 12*b* directly to the bristles 18*b* on the head 16*b*. A manually operated valve 50 is carried in the handle 12*b* between the toothpaste storage compartment 14*b* and the conduit 20*b* in the head 16*b***.

A snap-off rotary knob **28*b* removably attached to the other end 30*b* of the tubular handle 12*b* opposite the head 16*b*. An elongated screw 32*b* is mounted at one end to the rotary knob 28*b* and extends into the toothpaste storage compartment 14*b* in the handle 12*b*. A follower 34*b* having an elongated internally threaded collar 52 is threaded on the screw 32*b*. The storage compartment 14*b* in the handle 12*b* has elongated slots 54 on the inner surface thereof. The follower 34*b* has keys 56 that travel along the elongated slots 54 to prevent the rotation of the follower 34*b* with the screw 32*b*. When the manually operated valve 50 is activated and the rotary knob 28*b* is turned in the right direction the follower 34*b* will travel towards the head 16*b* to urge the toothpaste 26b through the conduit 20b to the bristles 18b**.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An improved fountain toothbrush comprising:

(a) a tubular handle having a sealed toothbrush storage compartment therein;

(b) a head with a plurality of bristles thereon having a conduit therein, said head removably connected to a sealed end of said handle, including means for connecting said conduit with said toothpaste storage compartment in said handle to provide toothpaste to said bristles on said head when said head is mounted on said handle; and (c) means for forcing toothpaste in said toothpaste storage compartment through said conduit to said bristles; wherein said urging means includes:

(d) a snap-off rotary knob removably attached to other end of said tubular handle opposite said head;

(e) an elongated removable screw mounted at one end to the rotary knob and extending into said toothpaste storage compartment in said handle;

(f) a follower is threaded on said screw;

(g) means for preventing rotation of said follower with said screw so that when said rotary knob is turned in the right direction said follower will travel toward said head on said screw to urge the toothpaste through said conduit to said bristles; wherein said rotation preventing means includes:

(h) said storage compartment in said handle having at least one elongated key track on the inner surface thereof; and (i) said follower having at least one key way that travels along said at least one elongated key track to prevent the rotation of the follower with said screw; further including:

(j) a rib ring having a pair of oppositely disposed transverse slots, said rib ring affixed to the other end of said tubular handle opposite said head; and (k) said rotary knob having a pair of oppositely disposed hook members, in which said hook members are retained onto said rib ring through said slots when said rotary knob fits over said rib ring; and (l) an alignment arrow carried on said tubular handle above one of said slots so that said rotary knob can be properly positioned to remove said hook members from said rib ring.

* * * * *